US008356589B2

(12) United States Patent
Karnis

(10) Patent No.: US 8,356,589 B2
(45) Date of Patent: Jan. 22, 2013

(54) PAINTBALL LOADER

(75) Inventor: Nicholas Karnis, Lachine (CA)

(73) Assignee: GI Sportz, Inc., Quebec (CA)

( * ) Notice: Subject to any disclaimer, the term of this patent is extended or adjusted under 35 U.S.C. 154(b) by 842 days.

(21) Appl. No.: 12/372,261

(22) Filed: Feb. 17, 2009

(65) Prior Publication Data

US 2009/0211562 A1 Aug. 27, 2009

Related U.S. Application Data

(60) Provisional application No. 61/028,927, filed on Feb. 15, 2008.

(51) Int. Cl.
*F41B 11/02* (2006.01)

(52) U.S. Cl. ..... 124/48; 124/1; 124/51.1; 124/56; 221/164; 221/167; 221/171; 221/186

(58) Field of Classification Search ..... 124/48, 124/51.1, 1, 56; 221/164, 167, 171, 186
See application file for complete search history.

(56) References Cited

U.S. PATENT DOCUMENTS

| | | | | | |
|---|---|---|---|---|---|
| 1,764,352 | A | * | 6/1930 | Sacerdote | 221/186 |
| 2,348,927 | A | * | 5/1944 | Runsvold et al. | 221/110 |
| 2,394,606 | A | * | 2/1946 | Gazda | 89/34 |
| 3,558,003 | A | * | 1/1971 | Jones | 221/2 |
| 3,715,055 | A | * | 2/1973 | Kendrick et al. | 221/75 |
| 4,159,065 | A | * | 6/1979 | Sevald | 221/167 |
| 4,185,608 | A | * | 1/1980 | Young et al. | 124/16 |
| 4,209,003 | A | * | 6/1980 | Sainsbury | 124/7 |
| 4,360,204 | A | * | 11/1982 | Karr | 473/137 |
| 4,454,971 | A | * | 6/1984 | Poehlmann | 224/196 |
| 4,560,086 | A | * | 12/1985 | Stol | 221/24 |
| 5,097,816 | A | * | 3/1992 | Miller | 124/49 |
| 5,335,579 | A | * | 8/1994 | David | 89/34 |
| 5,954,042 | A | * | 9/1999 | Harvey | 124/51.1 |
| 6,109,252 | A | * | 8/2000 | Stevens | 124/51.1 |
| 6,176,230 | B1 | * | 1/2001 | Thompson | 124/16 |
| 6,213,110 | B1 | * | 4/2001 | Christopher et al. | 124/51.1 |
| 6,415,781 | B1 | * | 7/2002 | Perrone | 124/51.1 |
| 6,502,567 | B1 | * | 1/2003 | Christopher et al. | 124/51.1 |
| 6,684,873 | B1 | * | 2/2004 | Anderson et al. | 124/82 |
| 6,739,323 | B2 | * | 5/2004 | Tippmann, Jr. | 124/51.1 |
| 6,889,680 | B2 | * | 5/2005 | Christopher et al. | 124/51.1 |
| 6,978,776 | B2 | * | 12/2005 | Hamilton | 124/51.1 |
| 7,343,909 | B2 | * | 3/2008 | Christopher et al. | 124/51.1 |

(Continued)

FOREIGN PATENT DOCUMENTS

GB 2224997 A * 5/1990

*Primary Examiner* — Gene Kim
*Assistant Examiner* — Alexander Niconovich

(57) ABSTRACT

A paintball loader for supplying a plurality of substantially similar paintballs a paintball marker. The loader comprises a housing adapted to receive the plurality of paintballs, the housing defining a feeder tube in a base thereof, the feeder tube dimensioned to allow single passage of the paintballs, a paintball receiving member comprising an elongate receiving channel spiraling radially outward in a direction of rotation from the feeder hole and having an outlet adjacent the feeder tube, the channel comprising a pair of opposing side walls spaced to allow single passage of the paintballs, and a feeder arm positioned across at least a portion of the channel walls such that the feeder arm comes into contact with one of the plurality of the paintballs when in the channel. The channel is rotatable relative to the feeder arm about the feeder hole in the direction of rotation.

20 Claims, 9 Drawing Sheets

U.S. PATENT DOCUMENTS

| | | | | |
|---|---|---|---|---|
| 7,350,515 | B2 * | 4/2008 | Yao et al. | 124/51.1 |
| 7,357,129 | B2 * | 4/2008 | Neumaster et al. | 124/48 |
| 7,357,130 | B2 * | 4/2008 | Broersma | 124/51.1 |
| 7,445,002 | B2 * | 11/2008 | Christopher et al. | 124/51.1 |
| 7,568,478 | B2 * | 8/2009 | Hedberg | 124/51.1 |
| 7,591,260 | B1 * | 9/2009 | Mu | 124/51.1 |
| 7,694,669 | B2 * | 4/2010 | Campo | 124/51.1 |
| 7,841,328 | B2 * | 11/2010 | Italia et al. | 124/51.1 |
| 7,854,220 | B1 * | 12/2010 | Neumaster | 124/51.1 |
| 7,870,851 | B2 * | 1/2011 | Mahany | 124/56 |
| 8,047,190 | B2 * | 11/2011 | Kaakkola et al. | 124/48 |
| 2006/0054151 | A1 * | 3/2006 | Christopher et al. | 124/48 |
| 2006/0086347 | A1 * | 4/2006 | Hedberg | 124/51.1 |
| 2006/0130821 | A1 * | 6/2006 | Hamilton | 124/51.1 |
| 2006/0249131 | A1 * | 11/2006 | Broersma | 124/41.1 |
| 2006/0254572 | A1 * | 11/2006 | Hall | 124/74 |
| 2009/0241929 | A1 * | 10/2009 | Italia et al. | 124/51.1 |
| 2010/0206282 | A1 * | 8/2010 | Italia et al. | 124/51.1 |

* cited by examiner

PAINTBALL LOADER

CROSS REFERENCE TO RELATED APPLICATIONS

This application claims priority on U.S. provisional application Ser. No. 61/028,927 filed on Feb. 15, 2008 which is incorporated herein in its entirety by reference.

FIELD OF THE INVENTION

The present invention relates to a paintball loader, more particularly to a horizontally mounted spiral paintball loader to be mounted within a paintball hopper to feed paintballs to a paintball marker.

BACKGROUND OF THE INVENTION

In the competitive game of paintball, it is important to have an uninterrupted supply of paintballs fed to a marker/gun at a pre-established speed. In a basic configuration without a loader, paintballs are housed in a hopper above the marker and are gravity-fed into the marker through a feeder tube. However, this variant is not suitable for competitive play because paintballs often get jammed in the hopper on their way to the feeder tube, requiring the player to give the marker a good shake to dislodge the paintball jam in order to continue playing.

During a game, time is precious and if a player has to stop to shake the marker, this delay can cost the game. Therefore, loader technology was introduced into the game of paintball to provide a player with a guaranteed steady stream of paintball ammunition at the squeeze of the trigger.

There is known U.S. Pat. No. 6,213,110 for a Rapid Feed Paintball Loader with a rotatable drive cone with a plurality of vertical fins. This apparatus feeds paintballs into the inlet or feeder tube of a paintball gun at a steady rate. However, the design of this invention necessitates a certain height to allow for the drive cone shape, and does not line up each paintball several balls in advance before feeding it into the feeder tube.

There is also known U.S. Pat. No. 6,415,781 for a Bulk Loader for Paintball Gun. This invention comprises a vertically-mounted screw configured to push paintballs into a feeder tube. This invention requires a relatively large screw mounted inside a paintball hopper; not only does this design consume valuable space intended for paintballs, but the apparatus relies on a microswitch to be activated.

There is also known U.S. Pat. No. 6,502,567 for a Rapid Feed Paintball Loader with Pivotable Deflector. As in U.S. Pat. No. 6,213,110, the device does not line up a set number of paintballs in advance for an assured stream of ammunition.

SUMMARY OF THE INVENTION

The present invention is designed to overcome the defects of the prior art. In a space efficient manner, the present apparatus arranges a plurality of paintballs in a line before feeding them into the feeder tube. This is accomplished by using a spiral channel configuration. The prior art inventions rely on a chance encounter between a turning vane on a spinning axis and a paintball; in an illustrative embodiment of the present invention, there are no vanes: instead, a channel arranged in a spiral collects gravity fed paintballs and feeds them surely into the feeder tube.

The mechanism is simple in construction, relatively compact, and does not need to be activated by a trip switch. In a particular embodiment the paintball loader comprises a housing with a spinning rotating spiraling wall, an immobilized feeder arm and a feeder hole; the housing abuts a lower portion of a paintball housing, and attaches to the inlet tube of a paintball marker. Paintballs inside the hopper fall, are caught by the rotating spiral channel, and are urged towards the feeder hole by the feeder arm that is stationary in relation to the rotating spiral channel. The probability that the paintballs will jam or break is reduced, and the apparatus is capable of constant, reliable, sufficient speed.

More specifically, in accordance with the present invention, there is provided a paintball loader for supplying a plurality of substantially similar paintballs to a paintball marker. The loader comprises a housing adapted to receive the plurality of paintballs, the housing defining a feeder tube in a base thereof, the feeder tube dimensioned to allow single passage of the paintballs, a paintball receiving member comprising an elongate receiving channel spiraling radially outward in a direction of rotation from the feeder tube and having an outlet adjacent the feeder tube, the channel comprising a pair of opposing side walls spaced to allow single passage of the paintballs, and a feeder arm positioned across at least a portion of the channel walls such that the feeder arm comes into contact with one of the plurality of the paintballs when in the channel. The channel is rotatable relative to the feeder arm about the feeder hole in the direction of rotation.

There is also disclosed a method for supplying a sequential stream of paintballs to an inlet tube of a marker. The method comprises positioning a feeder tube adjacent the inlet tube, arranging the paintballs in a row spiraling outward in a direction of rotation from the feeder tube, positioning a feeder arm such that the feeder arm comes into contact with a rearward one of the plurality of the paintballs when in the channel, and rotating the feeder arm relative to the row in the direction of rotation.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Generally, the illustrative embodiment of the present invention arranges paintballs in a row prior to feeding them through the feeder tube to a paintball marker. A simple electric motor that is synchronized with a marker trigger assembly can be used to rotate a spiraling channel retaining the row of paintballs relative to a feeder arm and thus urge the paintballs to be propelled out of the channel towards the marker. The apparatus is typically interposed between hopper and feeder tube of a paintball marker.

Figure 1:
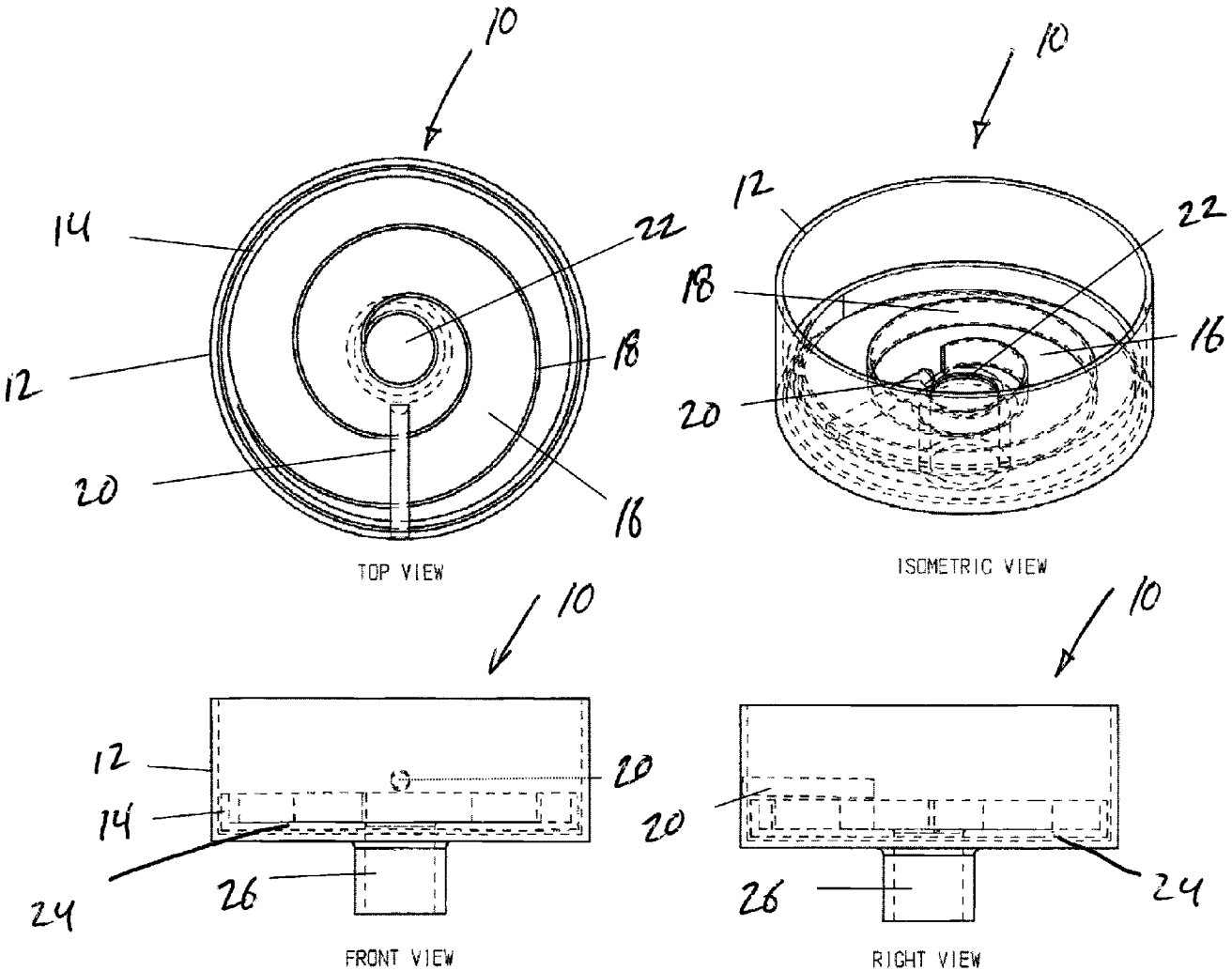
FIG. 1 discloses four (4) views of a paintball loader in accordance with an illustrative embodiment of the present invention, namely top, perspective, front and right views.

Referring now to FIG. 1, four views of an illustrative embodiment of a paintball loader, generally referred to using the reference numeral 10, are shown; the loader 10 comprises a housing 12, paintball receiving member 14 with an elongate spiraling channel 16 defined by a channel wall 18, a feeder arm 20 illustratively attached to the housing 12 and a feeder hole 22 in a base element 24 of the paintball receiving member 14 that leads to feeder tube 26. An outlet of the channel 16 is positioned adjacent the feeder hole 22. Referring in particular to the Top View of FIG. 4, the wall 18 of the channel 16 is illustratively arranged such that it follows an Archimedean spiral, that is having a radius which increases by the same amount per 360 degree turn of the spiral. The spiral as illustratively disclosed has a radius r according to the following formula:

$$r=D(\tfrac{1}{2}+\theta/\pi) \quad (1)$$

where D is roughly equivalent to the sum of the diameter of a paintball and the thickness of the wall and θ is measured in radians.

Figure 2:
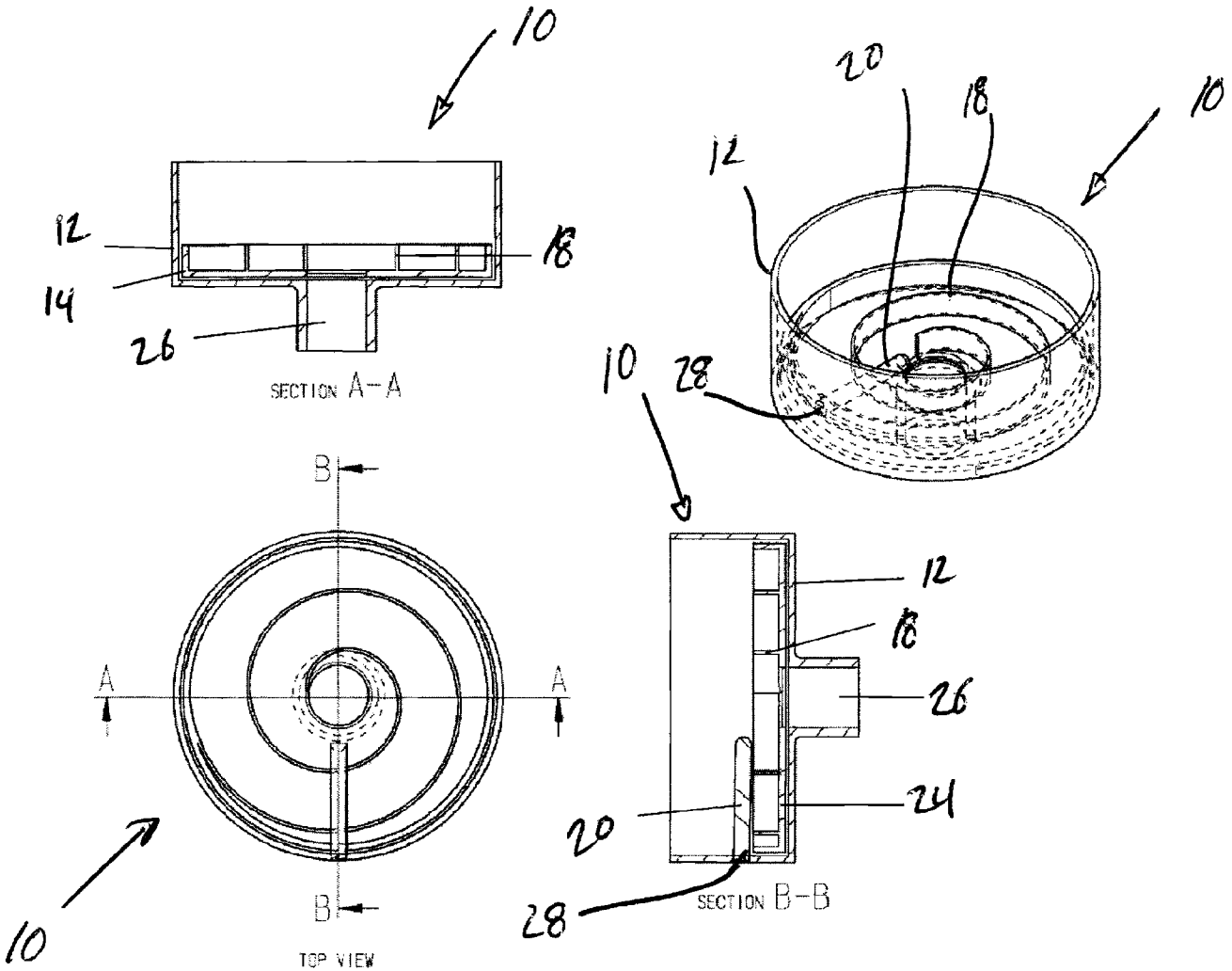
FIG. 2 discloses four (4) additional views of the paintball loader of FIG. 1, namely top, perspective, and two cross-sectional views.

FIG. 2 shows a cross-sectional view of paintball loader 10 with the wall 18 of the elongate spiraling channel 16, the attachment point 28 of the feeder arm 20 on housing 12 and feeder tube 26.

Figure 3:
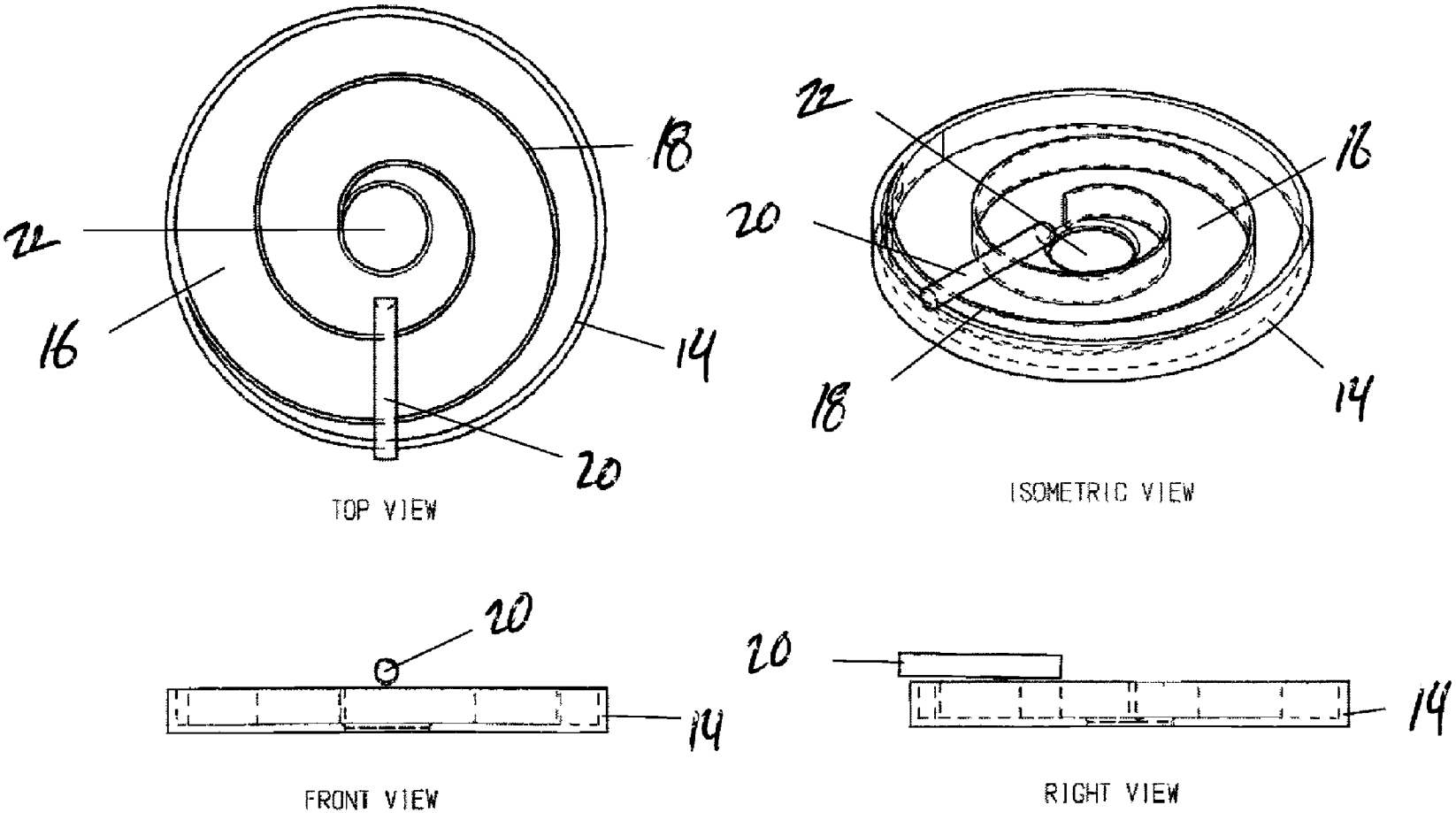
FIG. 3 discloses four (4) views of a paintball receiving channel interposed with a feeder arm in accordance with an illustrative embodiment of the present invention, namely top, perspective, front and right views.
Figure 4:
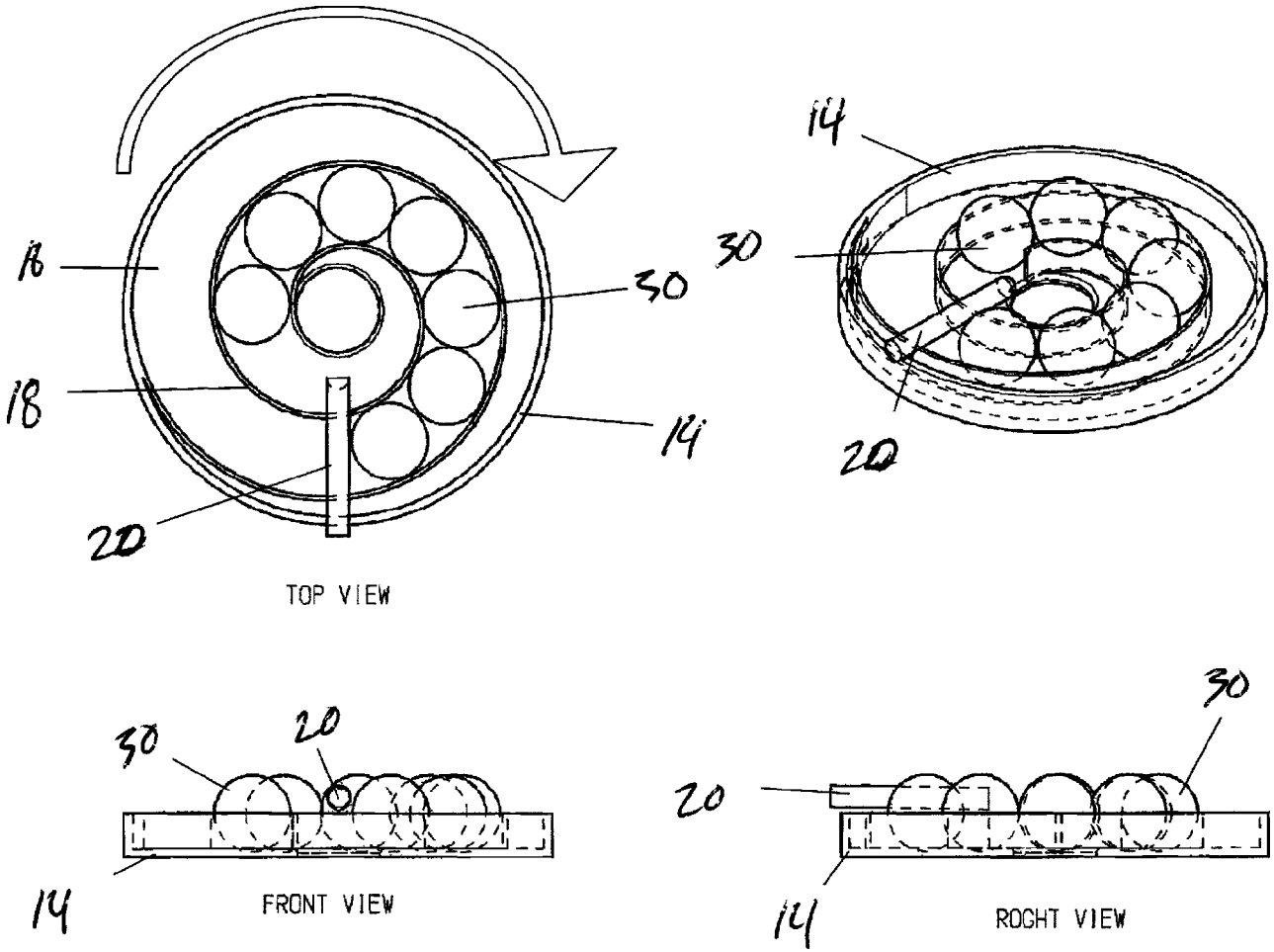
FIG. 4 discloses four (4) views of the channel and feeder arm of FIG. 3 together with paintballs, namely top, perspective, front and right views.

FIG. 3 discloses the paintball receiving member 14 together with feeder arm 20. The wall 18 of the channel 16 is of sufficient height to catch and hold paintballs in the channel 16 as the feeder arm 20 urges them towards the feeder hole 22. FIG. 4 demonstrates a configuration of paintballs 30 being held in the channel 16 by the wall 18 as the paintball receiving member 14 is rotated (illustratively clockwise) in the direction of rotation of the spiral channel, and the feeder arm 20 abuts the furthest paintball 30 furthest from the feeder hole 22. As seen on Front View of FIG. 4, the feeder arm 20 makes contact with a paintball 30 just above the horizontal meridian of the paintball 30. Also of note is that the wall 18 which defines the channel 16 is spaced slightly larger than one of the paintballs 30 such that the channel 16 is only able to receive the paintballs 30 in a sequential ordered fashion.

Figure 5:
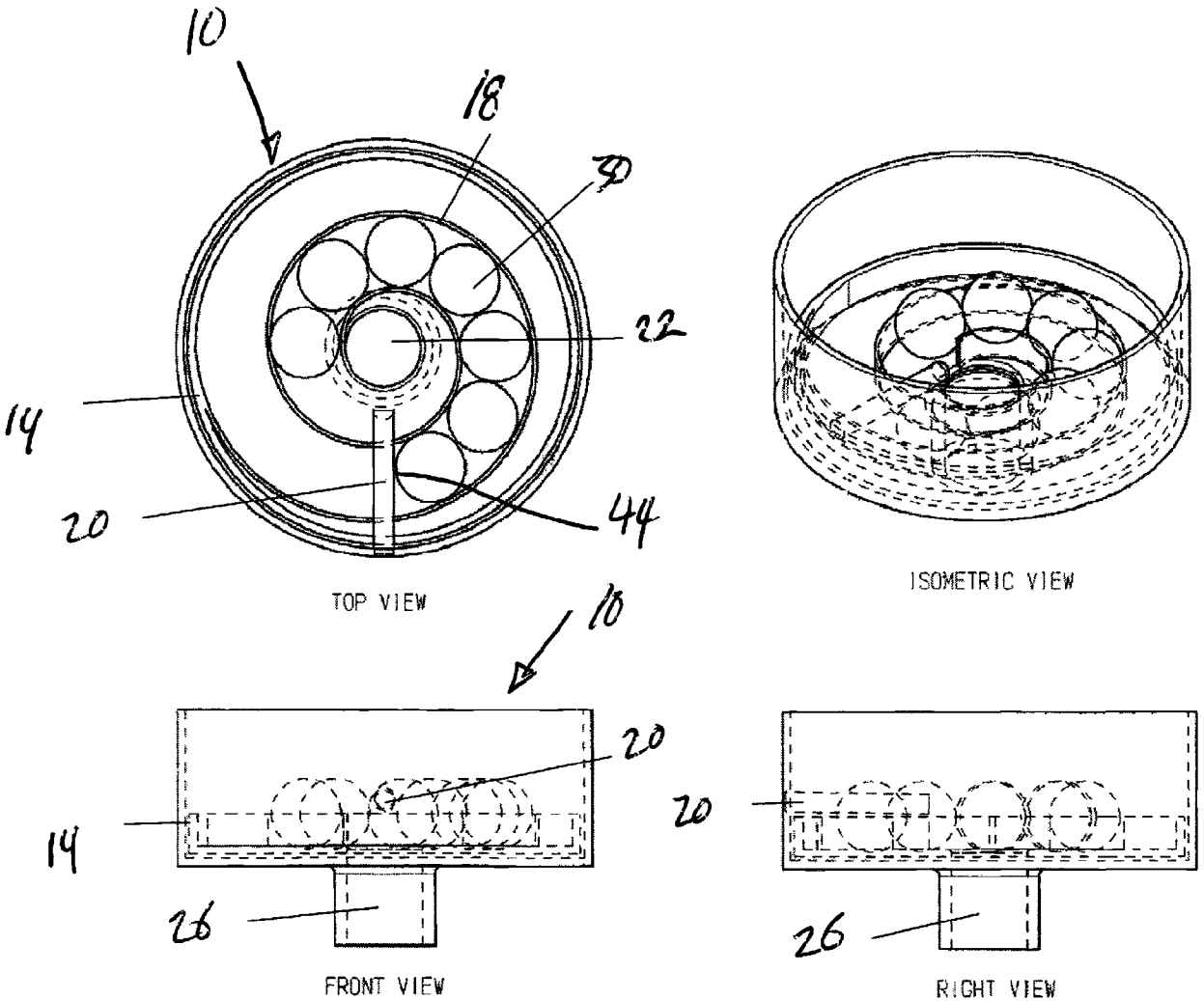
FIG. 5 discloses four (4) views of the paintball loader of FIG. 1 with paintballs, namely top, perspective, front and right views.
Figure 6A:
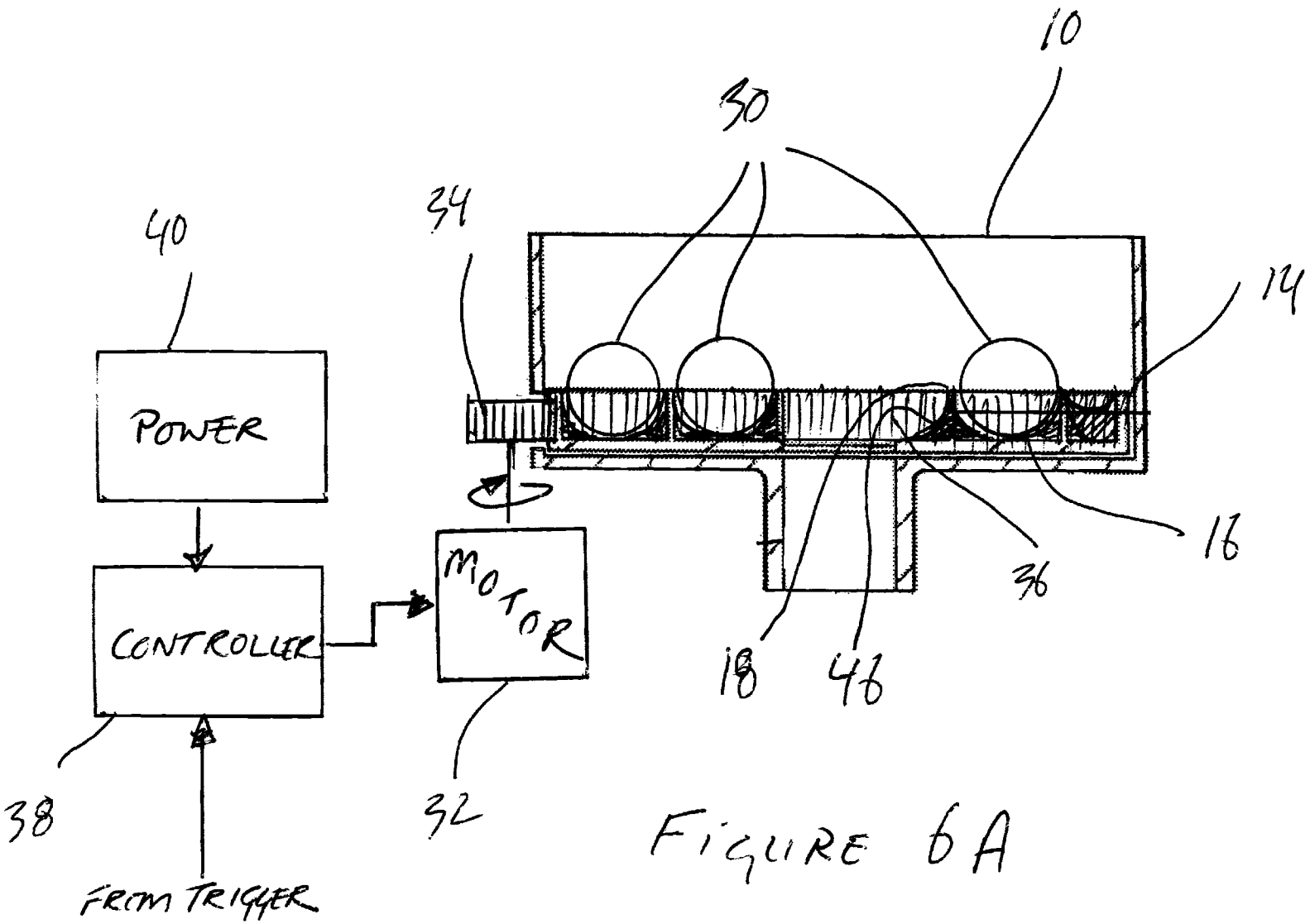
FIGS. 6A and 6B disclose side cutaway schematic views of a drive mechanism for a paintball loader in accordance with illustrative embodiments of the present invention.
Figure 6B:
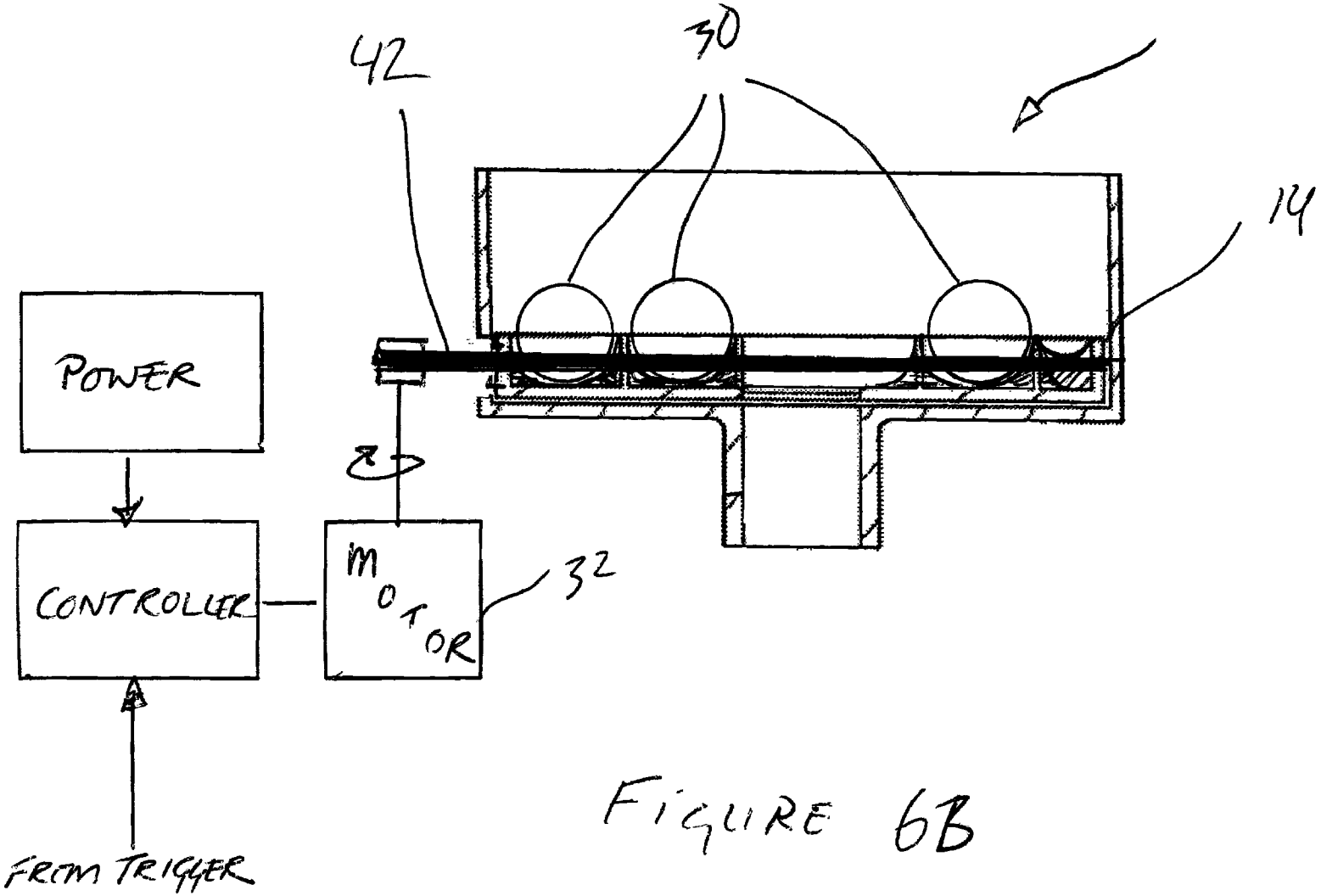

As seen on FIG. 5, illustratively the feeder arm 20 is stationary and fixed to an inner wall of the housing 12 which attaches to the inlet tube of a paintball marker (both not shown) via the feeder tube 26. Referring now to FIGS. 6A and 6B in addition to FIG. 5, a motor 32 rotates the paintball receiving member 14 in the same direction as the direction of spiral of the channel 16 (illustratively clockwise) thus forcing the feeder arm 20 to come into contact with a paintball 30 retained within the channel 16 defined by the wall 18, and thereby resulting in the paintballs 30 being urged in ordered sequence toward feeder hole 22. Still referring to FIG. 6A, illustratively the motor comprises a cog 34 which engages a serrated outer edge 36 of the paintball receiving member 14. The motor 32 is under control of a controller 38 which is operationally connected to the trigger mechanism of the marker (both not shown). A power supply 40 for powering the controller and the motor 32 is also provided. Illustratively, the controller 38 receives signals from the trigger mechanism and powers on and off the motor 32 to rotate the paintball receiving member 14 and advance the series of paintballs 30 towards the feeder hole 22 as required and in accordance with the firing of the marker.

Referring now to FIG. 6B, in an alternative illustrative embodiment the motor 32 can impart rotational force to the paintball receiving member 14 via a drive belt 42 in order to advance the series of paintballs 30 towards the feeder hole 22.

Referring Back to FIG. 5, in operation, housing 12 installs between hopper and paintball marker (both not shown). The hopper is filled with paintballs, and the paintballs fall onto the paintball receiving member 14 within the housing 12 where they are retained within the channel 16 by the wall 18. When the marker's trigger is activated, a motor (reference 32 in FIG. 6A) rotates the paintball receiving member 14 in the same direction as the direction of the spiraling channel 16 (illustratively clockwise) and paintballs 30 located in the channel 16 on the drive side 44 of the feeder arm 20 are thus urged towards and through feeder hole 22. As long as hopper contains paintballs, once paintballs 30 are pushed through feeder hole 22, new paintballs 30 fall under the force of gravity into and are retained inside the channel 16 by the wall 18; thus, the cycle is continuous. The paintball receiving member 14 illustratively rotates continuously, and the loader 10 can also illustratively comprise a jam detector (not shown) that stops paintball receiving member 14 from rotating allowing any jams of paintballs 30 to be cleared.

Various modifications are possible: for example, if more spiral turns are added to paintball receiving member 14, more paintballs 30 can be lined up for feeding through feeder hole 22. In another embodiment, paintball receiving member 14 can be stationary, for example directly molded into the bottom of the housing 12, and the feeder arm 20 can be rotating about the feeder hole 22 instead, thus pushing the paintballs 30 through the feeder hole 22.

Referring back to FIG. 6A, in an alternative illustrative embodiment of the present invention the walls 18 which define the channel 16 can include a curved profile 46 adapted to better receive the outer radius of a paintball as in 30.

Figure 7A:
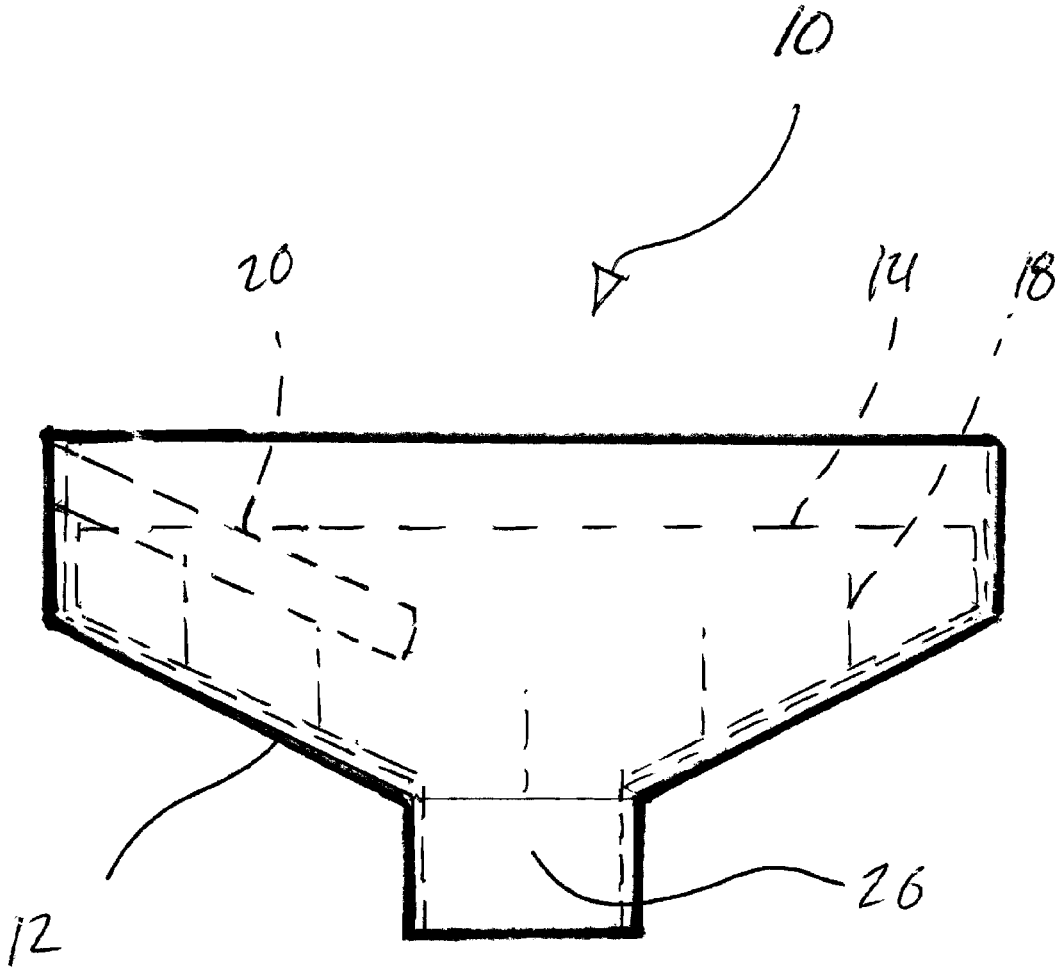
FIGS. 7A and 7B disclose side plan views of a paintball loader in accordance with second and third alternative illustrative embodiments of the present invention.
Figure 7B:
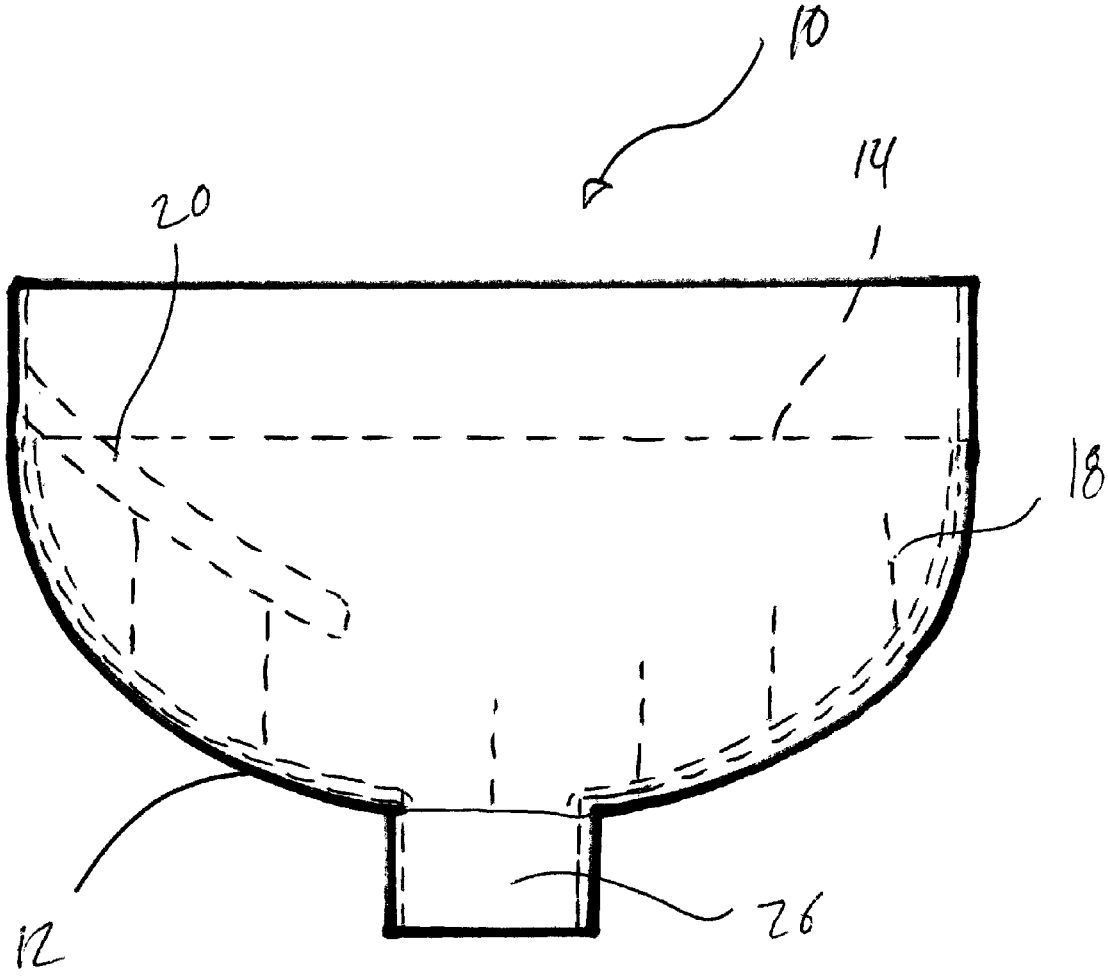

Referring now to FIG. 7A, in a second alternative illustrative embodiment, the housing 12 of the loader 10 and the paintball receiving member 14 can have an upside down cone shape with the apex of the cone and the outlet of the channel 16 defined by the walls 18 centered at the feeder tube 26. Referring now to FIG. 7B, in a third alternative illustrative embodiment, the housing 12 of the loader 10 and the paintball receiving member 14 can be of a bowl shape, with the based of the bowl and the outlet of the channel 16 defined by the walls 18 centered at the feeder tube 26. Additionally, in both alternative embodiments the positioning of the feeder arm 20 must be modified so that it illustratively comes into contact with a paintball in the channel 16 immediately above the paintball's horizontal meridian.

Although the present invention has been described hereinabove by way of specific embodiments thereof, it can be modified, without departing from the spirit and nature of the subject invention as defined in the appended claims.

The invention claimed is:

1. A paintball loader for supplying a plurality of substantially similar paintballs to a paintball marker, the loader comprising:

a housing adapted to receive the plurality of paintballs, said housing defining a feeder tube in a base thereof, said feeder tube dimensioned to allow single passage of the paintballs;

a paintball receiving member comprising an elongate receiving channel spiraling radially outward in a direction of rotation from said feeder tube and having an outlet adjacent said feeder tube, said channel comprising a pair of opposing side walls spaced to allow single passage of the paintballs; and a feeder arm positioned across at least a portion of said channel walls such that said feeder arm comes into contact with one of the plurality of the paintballs when in said channel;

wherein said channel is rotatable relative to said feeder arm about said feeder tube in said direction of rotation.

2. The loader of claim 1, wherein said feeder arm is fixed and said channel is rotatable about said feeder tube in said direction of rotation.

3. The loader of claim 1, wherein said feeder arm comes into contact with one of the plurality of the paintballs immediately above a horizontal meridian of the paintball.

4. The loader of claim 2, wherein said paintball receiving member further comprises a base element on which said channel is attached, said base element defining a feeder hole concentric with said feeder tube and adjacent said outlet.

5. The loader of claim 4, wherein said base element comprises a shape selected from the group consisting of flat, cone shaped or bowl shaped.

6. The loader of claim 1, wherein said channel walls are formed from a continuous band of material.

7. The loader of claim 6, wherein said band follows an Archimedean spiral.

8. The loader of claim 7, wherein said Archimedean spiral has a radius substantially equal to $D(1/2+\theta/\pi)$ where D is approximately equal to a sum of a diameter of one of the paintballs and a thickness of said band.

9. The loader of claim 1, wherein said channel walls are flat.

10. The loader of claim 1, wherein said channel walls comprise a concave profile having a radius substantially the same as an outer radius of one of the paintballs.

11. The loader of claim 1, wherein said feeder tube is configured for attachment to an inlet tube of the paintball marker.

12. The loader of claim 1, further comprising a drive mechanism for rotating said paintball receiving member relative to said feeder arm.

13. The loader of claim 12, wherein said drive mechanism is operationally connected to a triggering mechanism of said marker and further wherein when the triggering mechanism is engaged, said drive mechanism advances a rotation of said paintball receiving member relative to said feeder arm in an amount necessary to introduce one of the paintballs into the feeder tube.

14. The loader of claim 12, wherein said drive mechanism comprises a motor.

15. The loader of claim 14, wherein said paintball receiving member is rotatable about said feeder tube and further wherein said motor rotates said paintball receiving member in said direction of rotation.

16. The loader of claim 15, wherein said paintball receiving member comprises a circular outer edge and further wherein said motor engages said outer edge for rotating said paintball receiving member in said direction of rotation.

17. The loader of claim 16, wherein said outer edge is serrated and wherein said motor drives a serrated cog configured and positioned to engage said outer edge.

18. The loader of claim 15, further comprising a belt around said outer edge, and further wherein said motor drives said belt in said direction of rotation.

19. A paintball loader for supplying paintballs to a paintball marker, said paintball loader comprising:

a housing configured to receive and house a quantity of paintballs;

a feed tube arranged centrally in a bottom portion of said housing and configured to supply said paintballs from said housing to a paintball marker connected to said feed tube;

a receiving member comprising a receiving channel that radiates spirally outward from the feed tube toward a side wall of the housing, said receiving channel sized to receive a single-file line of paintballs into the receiving channel;

a feeder arm configured to contact at least one of the paintballs in the receiving channel; and a drive mechanism configured to rotate the receiving member and feeder arm relative to each other to urge paintballs in the receiving channel toward the feed tube.

20. A paintball loader comprising:

a substantially cylindrical shaped body having a substantially vertical side wall and a substantially planar bottom member defining a chamber configured to receive and house a quantity of paintballs;

a feed tube located centrally with respect to said body and having a passage communicating with said chamber through a centrally located opening in said bottom member;

a receiving member comprising a sidewall arranged on the bottom member, said sidewall extending radially outward from the centrally located opening toward the side wall of the body to form a receiving channel, said receiving channel configured to receive paintballs in a single-file line in the receiving channel, and said receiving member sidewall having a height less than a diameter of a paintball arranged in the receiving channel; and a feeder arm configured to contact at least one of the paintballs arranged in the receiving channel and further configured to urge said single-file line of paintballs toward the feed tube.

* * * * *